United States Patent [19]

Littlefield

[11] 4,194,851

[45] Mar. 25, 1980

[54] UNIVERSAL HUB FOR GEODESIC DOMES

[75] Inventor: Herrick B. Littlefield, Darien, Conn.

[73] Assignee: Polyproducts Corp., Long Island City, N.Y.

[21] Appl. No.: 850,359

[22] Filed: Nov. 10, 1977

[51] Int. Cl.[2] ..... F16D 1/00; F16D 3/00; F16G 11/00

[52] U.S. Cl. ..... 403/218; 52/80

[58] Field of Search ..... 403/217, 218, 219, 166, 403/373; 52/81, 80, 648, DIG. 10; 135/DIG. 9

[56] References Cited

U.S. PATENT DOCUMENTS

| | | | |
|---|---|---|---|
| 3,006,670 | 10/1961 | Schmidt | 52/81 X |
| 3,323,820 | 6/1967 | Braccini | 403/218 |
| 3,463,519 | 8/1969 | Raymond | 403/166 X |
| 3,475,768 | 11/1969 | Burton | 52/80 X |

FOREIGN PATENT DOCUMENTS

| | | | |
|---|---|---|---|
| 163721 | 9/1953 | Australia | 403/217 |
| 1418222 | 10/1965 | France | 403/218 |

*Primary Examiner*—Wayne L. Shedd

*Attorney, Agent, or Firm*—Curtis, Morris & Safford

[57] ABSTRACT

A universal hub for interconnecting the structural members of a geodesic type building consists of a pair of identical hub members, having inner and outer faces, which are positioned in superimposed relation to each other to define a slot therebetween which receives the ends of the geodesic dome's supporting struts. Connecting means secure the two hub members or discs together to clamp the ends of the struts therebetween and hold them in a relatively fixed position.

11 Claims, 7 Drawing Figures

FIG. 1
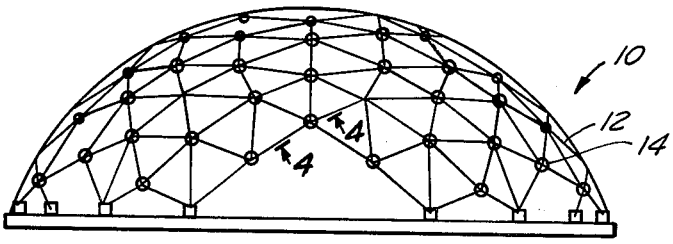
FIG. 5
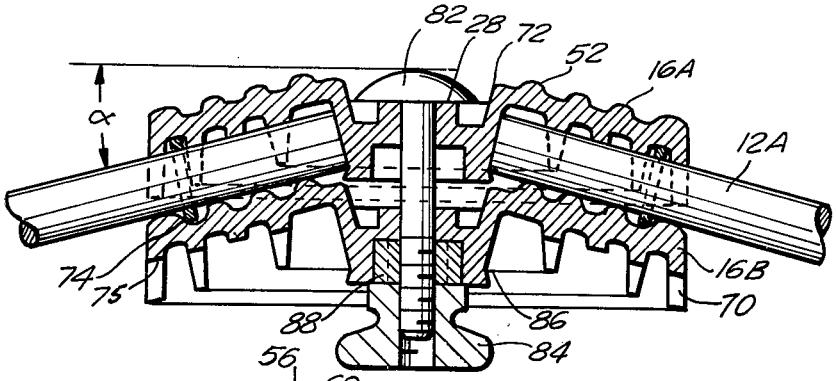
FIG. 4
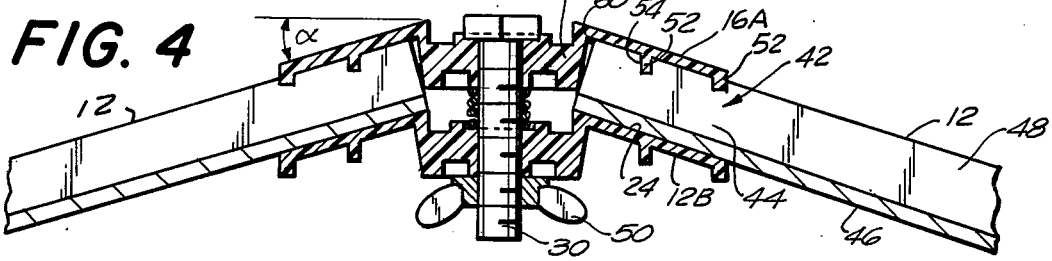
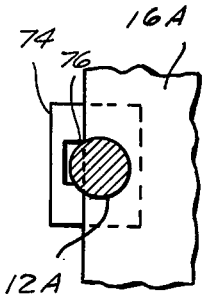
FIG. 7
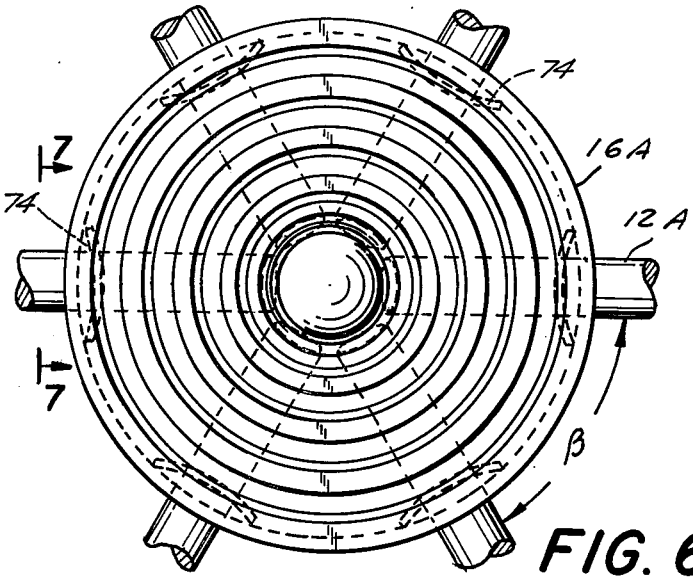
FIG. 6

UNIVERSAL HUB FOR GEODESIC DOMES

The present invention relates to geodesic dome structures, and in particular to a universal hub arrangement for joining together the individual supporting struts of such structures.

Geodesic type dome structures or space frame systems, of the type originally developed by R. Buckminister Fuller, are well known as the most efficient and inexpensive structures for forming enclosures. Typically such structures are formed from a supporting frame of struts interconnected together in a geometric pattern of generally triangular, diamond-shaped, or other polygonal configurations, to form a frame which is covered with a membrane material. Such structures are generally semi-spherical in shape, however other non-spherical shapes can also be formed.

The advantages of geodesic dome structures of the type developed by R. Buckminister Fuller have been appreciated throughout the construction industry, and this has led to the development of a variety of different methods and arrangements for erecting and assembling such structures. Because of the multiplicity of parts which are used in assembling geodesic structures, and particularly because of the large number of similarly dimensioned struts used in the structures, and the repetitive connections therebetween, numerous attempts have been made to standardize the assembly procedure and in particular the form for the hubs used at the intersection of the angularly related struts, in order to minimize the number of different elements required to assemble the structure and to simplify the assembly of such structures. Such connectors are shown for example in U.S. Pat. Nos. 3,877,824; 3,333,375; and 3,323,820. However, each of these hubs require a number of different parts to form the desired connection between the struts of the structure, and they are all essentially planar structures which do not accommodate the angular relationship between adjacent struts as the struts of the geodesic dome structure follow the curvature of the structure. This makes it difficult to arrange the adjacent struts in the proper relationship to one another, and the multiplicity of parts necessary for the hub structure greatly increases the expense involved in manufacturing components for the structure.

In accordance with the present invention, the efficiencies of geodesic dome designs and constructions are enhanced by the provision of a low cost universal hub which will readily join the struts of the dome structure in a homogeneous unitary support system which can be readily assembled or disassembled. The arrangement provides a minimum of parts at the hub structure so that identical elements are used at each joint in the structure, with the elements of the hub forming the joint being identical and providing for the necessary angular relationship between the connected struts.

In accordance with an aspect of the present invention a universal hub structure for interconnecting the struts of a geodesic type dome structure consists of a pair of identically formed generally frustro-conical hub discs having inner and outer surfaces, which discs are adapted to be positioned in superimposed spaced nested relation to each other with the inner surface of one disc facing the outer surface of the other disc to define a slot therebetween. The struts of the dome have connecting ends which are received in the slot between these discs, and connecting means are provided for releasably clamping the discs against the connecting ends of the structural members in the slot therebetween. With this arrangement anyone erecting the structure simply places two discs together about the connecting members and clamps them together. All of the discs in the dome are alike, so that the assembler does not have to take care to associate proper disc or joint components with one another in order to form a completed joint, as would be the case for example in the Braccini joint structure shown in U.S. Pat. No. 3,323,820. The hub disc used in accordance with this invention are constructed to automatically define the proper angular relationship between adjacent struts in the structure, and to cooperate with these struts to prevent longitudinal movement thereof out of the joint.

The above, and other objects, features and advantages of this invention will be apparent in the following detailed description of an illustrative embodiment thereof, which is to be read in connection with the accompanying drawings, wherein:

FIG. 1 is an elevational view of a geodesic type dome structure incorporating the universal hubs constructed in accordance with the present invention;

FIG. 4 is a sectional view of the assembled hub construction of the present invention;

FIG. 5 is a sectional view, similar to FIG. 4, of another embodiment of the present invention;

FIG. 6 is a plan view of the assembly shown in FIG. 5; and

FIG. 7 is an end view taken along line 7—7 of FIG. 6.

Figure 2:
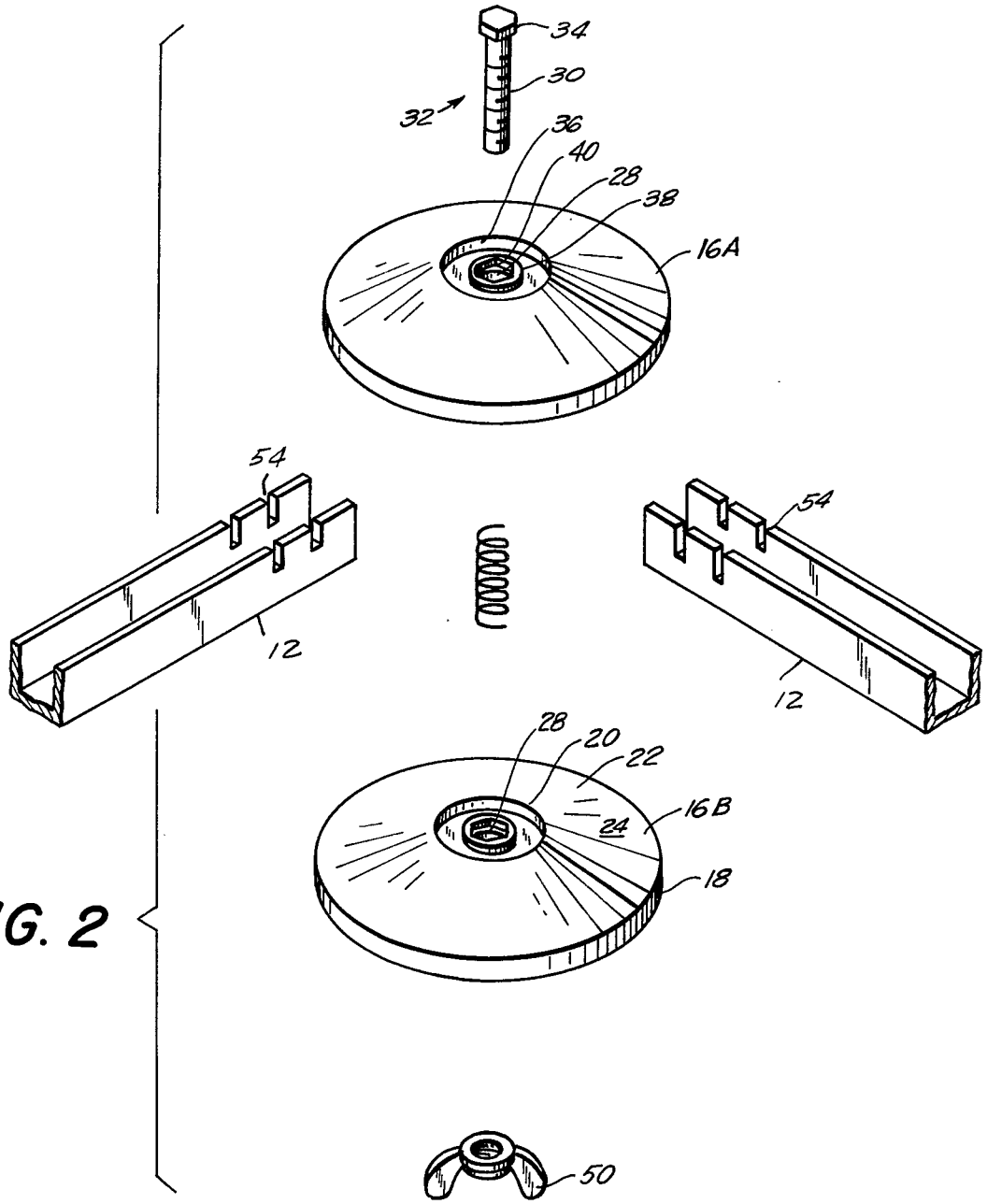
FIG. 2 is an exploded perspective view of a hub such as used in the dome shown in FIG. 1.
Figure 3:
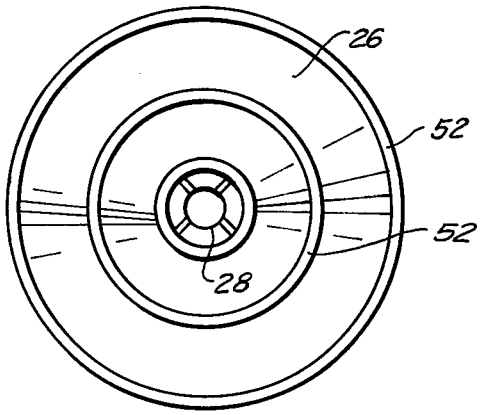
FIG. 3 is a bottom view of one of the hub discs, it being noted that each disc is identically constructed.

Referring now to the drawing in detail, and initially to FIG. 1 thereof, a geodesic type dome structure 10, constructed in accordance with the principles developed by R. Buckminister Fuller is illustrated. This dome structure has a generally semi-spherical configuration and is formed from a plurality of structural members or struts 12 interconnected in a generally triangular pattern with the intersections of the struts being connected together by hub members 14, constructed in accordance with the present invention. The dome after assembly, is covered in any convenient manner by a membrane structure or by rigid plywood panels and the like in the known manner.

The hub structure 14 of the present invention is illustrated in FIG. 2. This hub structure facilitates the assembly operation for the dome since it consists preferably of identical elements at each hub to reduce the duplication of parts necessary for erecting the dome structure. As seen in FIG. 2, hub 14 includes a pair of identical discs 16 (identified in the drawing as 16A and 16B to distinguish between the upper and lower discs of the joint) which are formed of molded plastic material. However, it is contemplated that these hub discs can be formed of metal or other materials if desired. Each disc is of essentially frustro-conical configuration, having a large base segment 18, a smaller base segment 20 and an inclined annular peripheral wall 22 extending therebetween which defines upper and lower surfaces 24, 26 for the disc. It is noted that in the specification these surfaces are also sometimes referred to herein as the first and second surfaces of the disc respectively.

Each disc 16 has a central aperture 28 formed therein which is adapted to receive the stem 30 of bolt 32. The head 34 of the bolt 32 is received in a recess 36 on the outer surface of the upper disc 16A. In the illustrative embodiment of the invention, the aperture 28 in the disc is surrounded by a small annular boss 38 in recess 36, which boss has an internal recess 40 formed therein that is generally complementary in configuration to the head of the bolt, to hold the bolt against rotation.

As seen in FIG. 4, discs 16A, 16B are arranged in superimposed spaced, but nested relationship to each other, to define an annular space or slot 42 therebetween. This slot receives the connecting ends 44 of the struts 12. These struts are generally channel shaped structural elements, formed of aluminum or the like, which have a flat lower surface or base 46 and a pair of upstanding legs 48. The flat base 46 of the struts rests on the smooth upper surface 24 of the lower disc 16B, and is held against the lower disc by the upper disc 16A. The struts are clamped between the discs by the wing nut 50 which engages the threaded stem 30 of the bolt, adjacent the lower surface 26 of lower disc 16B. By this arrangement the angular relationship of the structural elements 12 at the hub joint with respect to each other and to the arc of the circle formed by the dome is established, without the necessity of the assembler making any adjustment to the hub or the frame elements.

Preferably lower surface 26 of each of the discs is provided with a plurality (two in the illustrative embodiments) of projecting annular rings 52, surrounding the central aperture 28 in the disc. These rings form ribs which are received in notches or recesses 54 formed in the upstanding legs 48 of the struts 12. By this arrangement when struts 12 are clamped in position, they are held against longitudinal movement out of slot 42 between the hub discs 16A, 16B. On the other hand, inward longitudinal movement of these ribs is resisted by the provision of an annular boss 56 about aperture 28 on the lower surface 26 of the disc. This boss is positioned to engage the end 60 of the struts 12 when rings 52 are engaged in notches 54 of the struts. Thus longitudinal movement of the struts in either direction is resisted by the construction of the universal hub of the present invention.

In order to aid in maintaining the relative relationship of the two discs with respect to one another during the assembly procedure, the connection between the discs includes a coiled spring element 62, which surrounds the stem 30 of bolt 32, between the discs 16A and 16B. One end of spring 62 engages the lower surface 26 of boss 52 of disc 16A, while the other end is received in the pocket or recess 40 within the base 38 of disc 16B. Thus pockets 40 in the discs serve a dual purpose, as a seat for the bolt head 34 when the disc forms an upper disc 16A, and as a seat for the spring 62 in the lower disc which prevents lateral movement of the spring in the assembly.

Accordingly, it is seen that by this construction of the invention identical hub discs are utilized, which serve to clamp the struts in a tight locking engagement with each other at their intersection in the geodesic dome arrangement, and to hold the struts against longitudinal movement in either direction. However, the angular relationship of the struts about the hub, i.e. the angle between adjacent struts, is readily adjusted, to accommodate the necessary fit to adjacent hubs, as the struts can conveniently slide between the two discs, upon loosening of the nut 50, with that sliding motion being guided by the engagement of rings 52 in slots 54 of the struts. When a proper lateral angular relationship of all struts is achieved, nut 50 is turned on bolt 32 to lock the struts in place. This also automatically establishes the necessary vertical angular relationship between the struts at the hub in relation to the arc of the dome, i.e. the angle $\alpha$ shown in FIG. 4 is established by the discs themselves and requires no adjustment by the assembler in order to insure that the proper curvature of the dome is followed during the erection procedure. This is achieved with a minimum number of parts, as all of the hub discs in the structure are identical.

Another embodiment of applicant's invention is illustrated in FIGS. 5–7 of the drawings. In this embodiment of the invention identical discs 16A, and 16B are also provided. However in this form of the invention the upper surface 24 of each disc is also provided with annular rings 52, which are spaced radially outwardly from each other along the surface 24. In addition, there are a plurality of rings 52 formed on the lower surface 24 of each disc. This embodiment of the invention is shown in the drawings as being used with tubular shaped struts 12A, in the form of wooden dowels or cylindrical tubes and the like. The rings 52 on the lower surface of the discs are notched, as seen in FIG. 5, with notches 70 formed therein having an arcuate extent slightly greater than semicircular, to receive struts 12A therein in a tight friction fit. By this arrangement the notches 70 define the lateral angular relationship, identified by the angle $\beta$ in FIG. 6, between struts 12A, so that no adjustment of that angular relationship is required in the assembly of the joint structure. Again however, the frustro-conical configuration of the discs establishes the angle $\alpha$ between the struts and the curvature of the dome.

Hub discs 16A and 16B in the embodiment of the invention shown in FIG. 5 are also provided with central annular hubs or bosses 72, against which the ends 60 of the struts 12A abut, to limit the inward longitudinal movement of the struts with respect to the hub discs.

Each strut 12A is also provided with a generally rectangular lock washer 74 having an aperture 76 formed therein so that the lock washer can slide on the connecting end of the strut. The lock washer is positioned on the strut 12A such that it will be located between two of the rings 52 on the inner surface 26 of the upper disc 16A and the outer surface 24 of the disc 16B. In this position the lock washer is canted against the strut 12A, and will prevent longitudinal outward movement of the strut with respect to the hub assembly.

Each hub 16A and 16B in the embodiment of FIGS. 5–7 also is provided with a central aperture 28 which receives a bolt 82 therein. The bolt cooperates with a nut 84, as illustrated in FIG. 5, to clamp the two discs 16A and 16B against the struts 12A. A spring similar to the spring 62 previously described may be provided about the bolt 82, but is not shown in FIG. 5.

Bosses 72 on the discs 16A and 16B of the embodiment of FIG. 5 have a lower recess 86 formed therein which has a configuration that is generally complementary to the configuration of a polygonal lock nut 88, which is adapted to be received in recess 84 and lower disc 16B, to cooperate with nut 84 and form a lock assembly when the nuts are tightened.

Accordingly it is seen that by this embodiment of the present invention a simple hub assembly is also provided, which uses only identical parts, that establishes the necessary angle $\alpha$ between the curvature of the dome and the plane of the struts 12A, to insure that the erected structure conforms with the desired degree of curvature of the completed dome structure.

Although illustrative embodiments of the present invention have been described herein with reference to the accompanying drawings, it is to be understood that the invention is not limited to those precise embodiments, and that various changes and modifications may be effected therein by one skilled in the art without departing from the scope or spirit of this invention.

What is claimed is:

1. A joint hub for interconnecting the struts of a geodesic type structure comprising a pair of identical one piece generally frusto-conical hub members each having first and second opposite faces and a centrally located aperture formed therein, said hub members being adapted to be positioned in superimposed relation to each other with the first face of one hub member facing and extending parallel to the second face of the other hub member to define a frusto-conical slot therebetween for receiving the ends of said struts; means formed on at least one face of said hub member for cooperative interengagement with said end portions of said struts to permit circumferential movement of said struts within said hub members while precluding longitudinal movement; and connection means for extending through said apertures for securing said hub members together while clamping said end portions of said struts between and in engagement with respective first and second faces of the superimposed hub members to hold said struts in a relatively fixed position.

2. A joint hub as defined in claim 1 wherein said connection means comprises an elongated threaded bolt having a head and a stem extending through said apertures, said head being located on the side of one of said hub members opposite said struts and a nut on said stem located on the side of the other of said hub members opposite said struts.

3. A joint hub as defined in claim 2 wherein said connection means includes a coiled spring surrounding the stem of said bolt and positioned between said hub members.

4. A joint hub as defined in claim 1 wherein the slope of said frustro-conical hub members is substantially equal to the degree of curvature of said geodesic structure.

5. A joint hub as defined in claim 1 wherein said first faces of said hub members are smooth and said second faces have annular projecting rings formed thereon to form said means for cooperative interengagement with said ends of said end portions of said struts.

6. A joint hub as defined in claim 5 wherein said end portions of said struts have transverse slots formed therein receiving said rings whereby longitudinal movement of said struts is prevented.

7. A joint hub as defined in claim 6 wherein said second face of said hub members has an integral annular boss formed therein about said aperture dimensioned to engage the end portions of said struts when the slots therein are positioned to receive said rings.

8. A joint hub for interconnecting the struts of a geodesic type structure comprising a pair of identical hub members each having first and second opposite faces and a centrally located aperture formed therein, said hub members being adapted to be positioned in superimposed relation to each other with the first face of one hub member facing the second face of the other hub member to define a slot therebetween for receiving the ends of said struts; and connection means for extending through said apertures for securing said hub members together while clamping said end portions of said struts between the respective first and second faces of the superimposed hub members to hold said struts in a relatively fixed position: said hub members being generally frustro-conical in shape and said second faces of the hub members having annular projecting rings formed thereon including recesses in said rings which are generally complementary to and adapted to receive said end portions of the struts; and lock washers received on the ends of said struts between said hub members for preventing longitudinal movement of the struts with respect to said hub.

9. A joint hub as defined in claim 8 wherein said first surface of said hub members has spaced annular projecting rings formed thereon and said lock washers between said hub members being captured between the rings on the opposed first and second surfaces of the hubs forming said slot.

10. A joint hub as defined in claim 9 wherein said second face of said hub members has an annular boss formed therein about said aperture dimensioned to engage the end portions of said struts when the slots therein are positioned to receive said rings.

11. A joint hub for interconnecting the struts of a geodesic structure comprising a pair of identically formed generally frusto-conical hub disc members having inner and outer surfaces and adapted to be positioned in superimposed spaced nested relation to each other with the inner surface of one hub disc member facing the outer surface of the other hub disc member to define a slot therebetween, said hub disc members having a slope substantially equal to the degree of curvature of said geodesic structure and each of said hub disc members having a centrally located aperture formed therein, a plurality of struts having connecting end portions received in said slot between said hub disc members, connecting means for releasably clamping said hub disc members against said connecting end portions of said struts in said slot therebetween comprising an elongated threaded bolt having a head and a stem extending through said apertures and a nut on said stem for clamping said hub disc members against connecting end portions of said struts and a coiled spring surrounding the stem of said bolt and positioned between said hub disc members, the inner surfaces of said hub disc members further including spaced annular rings formed thereon and an annular boss formed about said apertures to engage the connecting end portions of said struts and said outer surface of said hub disc members are smooth, said connecting end portions of said struts having transverse slots formed therein receiving at least one of said rings whereby the struts are supported in said slot along one side by the smooth surface of one hub disc member and restrained against longitudinal movement by the rings of the other hub disc member, and wherein said outer surfaces of said hub disc members also have spaced projecting annular rings formed thereon and said connecting end portions of said struts have lock washers mounted thereon located between pairs of projecting rings on the opposed inner and outer surfaces of the superimposed hub disc members to prevent longitudinal movement of the struts with respect to said hub disc members.

* * * * *